US007968444B2

(12) United States Patent
Luo et al.

(10) Patent No.: US 7,968,444 B2
(45) Date of Patent: Jun. 28, 2011

(54) LEAD-FREE TIN ALLOY ELECTROPLATING COMPOSITIONS AND METHODS

(75) Inventors: Yu Luo, Acton, MA (US); Neil D. Brown, Merrick, NY (US); Michael P. Toben, Smithtown, NY (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 0 days.

(21) Appl. No.: 12/655,554

(22) Filed: Dec. 31, 2009

(65) Prior Publication Data

US 2010/0216302 A1 Aug. 26, 2010

Related U.S. Application Data

(60) Provisional application No. 61/204,044, filed on Dec. 31, 2008.

(51) Int. Cl.
*H01L 21/44* (2006.01)
*C25D 3/60* (2006.01)

(52) U.S. Cl. ..... 438/597; 438/660; 438/674; 205/252

(58) Field of Classification Search ..... None
See application file for complete search history.

(56) References Cited

U.S. PATENT DOCUMENTS

| | | | |
|---|---|---|---|
| 4,390,709 | A | 6/1983 | Weeks et al. |
| 4,880,507 | A | 11/1989 | Toben et al. |
| 5,162,585 | A | 11/1992 | Shaw |
| 5,378,347 | A | 1/1995 | Thomson et al. |
| 5,492,615 | A | 2/1996 | Houman |
| 5,939,565 | A | 8/1999 | Jumppanen et al. |
| 6,210,556 | B1 | 4/2001 | Toben et al. |
| 6,476,494 | B1 | 11/2002 | Hur et al. |
| 6,706,418 | B2 | 3/2004 | Egli et al. |
| 6,773,568 | B2 | 8/2004 | Egli et al. |
| 6,998,036 | B2 | 2/2006 | Dietterle et al. |
| 7,151,049 | B2 | 12/2006 | Beica et al. |
| 7,628,903 | B1 | 12/2009 | Tsuji et al. |
| 2009/0321269 | A1 | 12/2009 | Tsuji et al. |

FOREIGN PATENT DOCUMENTS

| | | | |
|---|---|---|---|
| EP | 0 810 303 | | 12/1997 |
| EP | 0 810 303 | A1 | 12/1997 |
| GB | 2 047 747 | A | 12/1980 |
| JP | 2000192279 | A | 7/2000 |
| JP | 2000328286 | A | 11/2000 |
| JP | 3489037 | | 1/2004 |
| JP | 3632499 | | 3/2005 |

*Primary Examiner* — Scott B Geyer
(74) *Attorney, Agent, or Firm* — John J. Piskorski

(57) ABSTRACT

Disclosed are electrolyte compositions for depositing a tin alloy on a substrate. The electrolyte compositions include tin ions, ions of one or more alloying metals, a flavone compound and a dihydroxy bis-sulfide. The electrolyte compositions are free of lead and cyanide. Also disclosed are methods of depositing a tin alloy on a substrate and methods of forming an interconnect bump on a semiconductor device.

8 Claims, No Drawings

LEAD-FREE TIN ALLOY ELECTROPLATING COMPOSITIONS AND METHODS

The present invention is directed to lead-free tin alloy electroplating compositions and methods. More specifically, the present invention is directed to lead-free tin alloy electroplating compositions and methods which provide improved tin alloy deposit morphology, improved reflow performance and may be deposited at high current densities.

Tin and tin-lead alloy deposits are useful for the electronics industry, particularly in the manufacture of printed wiring boards, electrical contacts and connectors, semi-conductors, electrical conduit and other related parts where the inherent properties of these deposits are highly desirable. Of the various electronic applications, there is a current focus in the semiconductor manufacturing industry on wafer-level-packaging (WLP). With wafer-level-packaging, IC interconnects are fabricated en masse on the wafer, and complete IC modules can be built on the wafer before it is diced. Benefits gained using WLP include, for example, increased I/O density, improved operating speeds, enhanced power density and thermal management, and decreased package size.

One of the keys to WLP is the build up of flip-chip conductive interconnect bumps on the wafer. These interconnect bumps serve as electrical and physical connections of the semiconductor components to a printed wiring board. Several methods of forming interconnect bumps on semiconductor devices have been proposed, for example, solder plate bumping, evaporation bumping, conductive adhesive bonding, stencil printing solder bumping, stud bumping, and ball placement bumping. Of these techniques, it is believed that the most cost effective technique for forming fine pitch arrays is solder plate bumping, which involves a combination of a temporary photoresist plating mask and electroplating. This technique is being rapidly adopted as full-area interconnect bump technology for high value-added assemblies such as microprocessors, digital signal processors, and application specific integrated circuits.

Electroplating methods for depositing tin, tin-lead and other tin-containing alloys are well known and many electrolytes have been proposed for electroplating such metals and alloys. For example, U.S. Pat. No. 4,880,507 discloses electrolytes, systems and processes for depositing tin, lead or a tin-lead alloy. The electronics industry has recently been in search of alternatives to tin-lead in light of the toxic properties of lead and the resulting current worldwide activities such as RoHS and WEEE directives to ban its use. Suitable replacements for tin-lead alloys desirably possess the same or sufficiently similar properties to the tin-lead for a given application. Once a suitable replacement material has been found, development of an electroplating process capable of depositing such material to impart the desired properties can be a challenge.

The industry desires that the composition of the deposits be effectively controlled to prevent melting of the material at too high or too low a temperature for a given application. Poor compositional control can result in either a temperature too high for the components being treated to withstand or, on the other extreme, incomplete formation of the solder joint.

Difficulties associated with co-deposition of lead-free tin alloys by electroplating arise when the materials being deposited have significantly different deposition potentials. Complications can arise, for example, when attempting to deposit alloys of tin (−0.137 V) with copper (0.34 V) or silver (0.799 V). To allow for co-deposition of such materials, the use of electrolytes that include cyanide compounds has been proposed. For example, Soviet Union Patent Application 377 435

A discloses a copper-tin alloy that is electrolytically deposited from a bath containing copper (I) cyanide, potassium cyanide, sodium stannate, sodium hydroxide and 3-methylbutanol. This electrolyte composition, however, has a very high cyanide concentration, making general handling as well as waste treatment hazardous.

Alternatives to co-deposition of such tin alloys by electroplating are known. For example, U.S. Pat. No. 6,476,494 discloses formation of silver-tin alloy solder bumps by electroplating silver on exposed portions of underbump metallurgy, plating tin on the silver, and reflowing the structure to form silver-tin alloy solder bumps. Composition of the silver-tin alloy is difficult to precisely control in this process as it depends on a number of variables which themselves must be accurately controlled. For example, the amount of silver that diffuses into the tin and thus silver concentration is a function of reflow temperature, reflow time, silver and tin layer thicknesses, as well as other parameters. Another proposed alternative to co-deposition of tin alloys involves tin electroplating followed by exchange plating of the alloying metal and a reflow process. Such a method typically requires a significant process time, and precise control of the alloy concentration can be difficult.

Another problem frequently encountered in electroplating bumps is bump morphology. For example, tin-silver mushroom shaped bumps are electrodeposited through a photoresist defined via onto a copper or nickel under bump metal. The photoresist is stripped and the tin-silver is reflowed to form spherical bumps. Uniformity of bump size is important such that all of the bumps make contact with their electrical connections on a corresponding flip-chip component. In addition to bump size uniformity, it is important that a low density and volume of voids are formed during bump reflow. Ideally, no voids are formed during reflow. Voids in the bumps may also lead to interconnection reliability issues when joined to their corresponding flip-chip component. Another problem associated with plating bumps is the formation of nodules on the bump surface which are readily detectable with many conventional scanning electron microscopes. Such nodules may cause reflow voiding, and appearance wise deposits with nodules are not commercially acceptable.

Accordingly, there is still a need for tin alloy electroplating compositions and methods which address the foregoing problems.

In one aspect, a composition includes one or more sources of tin ions, one or more sources of alloying metal ions, the metal ions are selected from the group consisting of silver ions, copper ions and bismuth ions, one or more flavone compounds, and one or more compounds having a formula: HOR(R")SR'SR(R")OH wherein R, R' and R" are the same or different and are alkylene radicals having 1 to 20 carbon atoms.

In another aspect, a method includes contacting a substrate with a composition that includes one or more sources of tin ions, one or more sources of alloying metal ions, the metal ions are selected from the group consisting of silver ions, copper ions and bismuth ions, one or more flavone compounds, and one or more compounds having a formula: HOR (R")SR'SR(R")OH wherein R, R' and R" are the same or different and are alkylene radicals having 1 to 20 carbon atoms; and passing a current through the composition to deposit a tin alloy on the substrate.

In a further aspect, a method includes providing (a) a semiconductor die having a plurality of interconnect bump pads; (b) forming a seed layer over the interconnect bump pads; (c) depositing a tin-alloy interconnect bump layer over the interconnect bump pads by contacting the semiconductor die with a composition that includes one or more sources of tin ions, one or more sources of alloying metal ions, the metal ions are selected from the group consisting of silver ions, copper ions and bismuth ions, one or more flavone compounds, and one or more compounds having a formula: HOR(R")SR'SR(R")OH wherein R, R' and R" are the same or different and are alkylene radicals having 1 to 20 carbon atoms; and (d) reflowing the interconnect bump layer.

The tin alloy compositions are free of lead as well as cyanide compounds. They can deposit tin alloys which are eutectic or near eutectic and may be deposited at higher current densities and plating rates than many conventional tin alloy electroplating compositions. Also, the tin alloy compositions are low foaming. In addition interconnect bumps deposited using the tin alloy compositions have substantially uniform morphology and provide void free or provide interconnect bumps after reflow having reduced density and volume of voids than many conventional tin alloy electroplating compositions. The interconnect bumps are also substantially free of nodules.

As used throughout the specification, the following abbreviations have the following meanings, unless the context clearly indicates otherwise: ° C.=degrees Centigrade; g=gram; mg=milligram; mL=milliliter; L=liter; ppm=parts per million; pm=microns; wt %=percent by weight; A=amps; $A/dm^2$ and ASD=amps per square decimeter; and min.=minute. Deposition potentials are provided with respect to a hydrogen reference electrode. Relating to the electroplating process, the terms "depositing", "coating", "electroplating" and "plating" are used interchangeably throughout this specification. "Halide" refers to fluoride, chloride, bromide and iodide. "Eutectic" means the lowest melting point of an alloy that is obtainable by varying the proportion of components; and having definite and minimum melting points in contrast to other combinations of the same metals. All percentages are by weight, unless otherwise noted. All numerical ranges are inclusive and combinable in any order, except where it is logical that such numerical ranges are construed to add up to 100%.

The compositions of the present invention include one or more sources of tin ions, one or more sources of alloying metal ions, the alloying metals ions are selected from the group consisting of silver ions, copper ions and bismuth ions, one or more flavone compounds and one or more compounds having a formula: HOR(R")SR'SR(R")OH wherein R, R' and R" are the same or different and are alkylene radicals having from 1 to 20 carbon atoms, typically from 1 to 10 carbon atoms. The compositions may be used to deposit a tin alloy on a substrate using conventional electroplating apparatus.

The electrolyte compositions and tin alloys are substantially free of lead. By "substantially free of lead" is meant that the composition and the tin-alloy contain 50 ppm or less of lead. In addition, the compositions are typically free of cyanide. Cyanide is primarily avoided by not employing any metal salts or other compounds in the compositions which include the $CN^-$ anion. The compositions also typically exclude thiourea and its derivatives, which are included in many conventional plating compositions.

The electrolyte compositions are also low foaming. Low foaming electrolyte compositions are highly desirable in the metal plating industry since the more the electrolyte composition foams during plating, the more components the composition looses per unit of time during plating. Loss of components during plating may result in producing commercially inferior metal deposits. Accordingly, workers must closely monitor component concentrations and replace lost components to their original concentration. Monitoring component concentrations during plating may be both tedious and difficult since some of the critical components are included at relatively low concentrations such that they are difficult to accurately measure and replace to maintain optimum plating performance. Low foaming electrolyte compositions improve alloy composition uniformity and thickness uniformity across a substrate surface and may reduce organics and gas bubbles trapped in the deposits which cause voids in the deposit after reflow.

Sources of tin ions in the compositions may be from any aqueous soluble tin compound. Suitable aqueous soluble tin compounds include, but are not limited to salts, such as tin halides, tin sulfates, tin alkane sulfonates, tin alkanol sulfonates, and acids. When tin halide is used, it is typical that the halide is chloride. The tin compound is typically tin sulfate, tin chloride or a tin alkane sulfonate, and more typically tin sulfate or tin methane sulfonate. The tin compounds are generally commercially available or may be prepared by methods known in the literature. Mixtures of aqueous soluble tin compounds may also be used.

The amount of tin compound used in the electrolyte compositions depends on the desired composition of the film to be deposited and operating conditions. Tin ion content may range from 5 to 100 g/L or such as from 5 to 80 g/L or such as from 10 to 70 g/L.

The one or more alloying metal ions used are those that are useful in forming binary, ternary and quaternary order alloys with tin. Such alloying metals are selected from the group consisting of silver, copper, and bismuth. Examples of alloys are tin-silver, tin-copper, tin-bismuth, tin-silver-copper, tin-silver-bismuth, tin-copper-bismuth and tin-silver-copper-bismuth. The alloying metal ions may result from the addition of any aqueous soluble metal compound or mixture of aqueous soluble metal compounds of the desired alloying metals. Suitable alloying-metal compounds include, but are not limited to, metal halides, metal sulfates, metal alkane sulfonates and metal alkanol sulfonates of the desired alloying metal. When a metal halide is used, it is typical that the halide is chloride. Typically the metal compound is a metal sulfate, a metal alkane sulfonate or a mixture thereof, and more typically a metal sulfate, a metal methane sulfonate or a mixture thereof. The metal compounds are generally commercially available or may be prepared by methods described in the literature.

The amount of the one or more alloying metal compounds used in the electrolyte compositions depend, for example, on the desired composition to be deposited and operating conditions. An alloying metal ion content in the composition may range from 0.01 to 10 g/L or such as from 0.02 to 5 g/L.

Any aqueous soluble acid which does not otherwise adversely affect the composition may be used. Suitable acids include, but are not limited to, arylsulfonic acids, alkanesulfonic acids, such as methanesulfonic acid, ethanesulfonic acid and propanesulfonic acid, aryl sulfonic acids such as phenylsulfonic acid and tolylsulfonic acid, and inorganic acids such as sulfuric acid, sulfamic acid, hydrochloric acid, hydrobromic acid and fluoroboric acid. Typically, the acids are alkane sulfonic acids and aryl sulfonic acids. Although a mixture of acids may be used, it is typical that a single acid used. The acids useful in the present invention are generally commercially available or may be prepared by methods known in the literature.

While depending on the desired alloy composition and operating conditions, the amount of acid in the electrolyte compositions may be in the range of 0.01 to 500 g/L or such as from 10 to 400 g/L or such as from 100 to 300 g/L. When the tin ions and ions of the one or more alloying metals in the composition are from a metal halide compound, use of the corresponding acid may be desired. For example, when one or more of tin chloride, silver chloride, copper chloride, or bismuth chloride are used, use of hydrochloric acid as the acid component may be desired. Mixtures of acids also may be used.

One or more flavone compounds are included in the compositions. Such compounds provide good grain structure to the tin alloy deposits and at the same time provide a uniform mushroom morphology to tin alloy interconnect bumps deposited from the compositions. Such flavone compounds include, but are not limited to, pentahydroxyl flavone, morin, chrysin, quercetin, fisetin, myricetin, rutin and quercitrin. The flavone compounds may be present in an amount of from 1 to 200 mg/L or such as from 10 to 100 mg/L or such as from 25 to 85 mg/L.

One or more compounds having a general formula: HOR(R")SR'SR(R")OH wherein R, R' and R" are the same or different and are alkylene radicals having 1 to 20 carbon atoms, typically 1 to 10 carbon atoms. Such compounds are known as dihydroxy bis-sulfide compounds. They improve tin alloy deposit morphology and inhibit formation of voids in the tin alloy bumps. The dihydroxy bis-sulfide compounds may be present in amounts of 0.5 to 15 g/L or such as from 1 to 10 g/L.

Examples of such dihydroxy bis-sulfide compounds include 2,4-dithia-1,5-pentanediol, 2,5-dithia-1,6-hexanediol, 2,6-dithia-1,7-heptanediol, 2,7-dithia-1,8-octanediol, 2,8-dithia-1,9-nonanediol, 2,9-dithia-1,10-decanediol, 2,11-dithia-1,12-dodecanediol, 5,8-dithia-1,12-dodecanediol, 2,15-dithia-1,16-hexadecanediol, 2,21-dithia-1,22-doeicasanediol, 3,5-dithia-1,7-heptanediol, 3,6-dithia-1,8-octanediol, 3,8-dithia-1,10-decanediol, 3,10-dithia-1,8-dodecanediol, 3,13-dithia-1,15-pentadecanediol, 3,18-dithia-1,20-eicosanediol, 4,6-dithia-1,9-nonanediol, 4,7-dithia-1,10-decanediol, 4,11-dithia-1,14-tetradecanediol, 4,15-dithia-1,18-octadecanediol, 4,19-dithia-1,22-dodeicosanediol, 5,7-dithia-1,11-undecanediol, 5,9-dithia1,13-tridecanediol, 5,13-dithia-1,17-heptadecanediol, 5,17-dithia-1,21-uneicosanediol and 1,8-dimethyl-3,6-dithia-1,8-octanediol.

The combination of the one or more flavone compounds and the one or more dihydroxy bis-sulfide compounds provide the improved interconnect bump morphology. The uniformity of the electroplated interconnect bumps and the elimination or the reduction in density and volume of voids in the bumps after reflow improves the electrical connections between component parts of an electrical device and the reliability of the device's performance. Additionally, the combination of the compounds eliminates or reduces the number of nodules formed on the bumps in contrast to bumps formed by many conventional tin alloy electroplating compositions.

Optionally, one or more suppressors may be included in the compositions. Typically they are used in amounts of 0.5 to 15 g/L or such as from 1 to 10 g/L. Such surfactants include, but are not limited to alkanol amines, polyethyleneimines and alkoxylated aromatic alcohols. Suitable alkanol amines include, but are not limited to, substituted or unsubstituted methoxylated, ethoxylated, and propoxylated amines, for example, tetra(2-hydroxypropyl)ethylenediamine, 2-{[2-(Dimethylamino)Ethyl]-Methylamino}Ethanol, N,N'-Bis(2-Hydroxyethyl)-ethylenediamine, 2-(2-Aminoethylamine)-Ethanol, and combinations thereof.

Suitable polyethyleneimines include, but are not limited to, substituted or unsubstituted linear or branched chain polyethyleneimines or mixtures thereof having a molecular weight of from 800-750,000. Suitable substituents include, for example, carboxyalkyl, for example, carboxymethyl, carboxyethyl.

Useful alkoxylated aromatic alcohols in the invention include, but are not limited to, ethoxylated his phenol, ethoxylated beta naphthol, and ethoxylated nonyl phenol.

Optionally, one or more antioxidant compounds may be used in the electrolyte compositions to minimize or prevent stannous tin oxidation from occurring, for example, from the divalent to tetravalent state. Suitable antioxidant compounds are known to those skilled in the art and are disclosed, for example, in U.S. Pat. No. 5,378,347. The antioxidant compounds include, but are not limited to, multivalent compounds based on the elements of groups IV B, V B, and VI B in the Periodic Table of the Elements, such as those of vanadium, niobium, tantalum, titanium, zirconium and tungsten. Of these, multivalent vanadium compounds, such as vanadium whose valences are $5^+$, $4^+$, $3^+$, $2^+$, are typically used. Examples of useful vanadium compounds include vanadium (IV) acetyl acetonate, vanadium pentoxide, vanadium sulfate, and sodium vanadate. Such antioxidant compounds when used in the compositions are present in an amount of 0.01 to 10 g/L or such as from 0.01 to 2 g/L.

A reducing agent may optionally be added to the electrolyte compositions to assist in keeping the tin in a soluble, divalent state. Suitable reducing agents include, but are not limited to, hydroquinone and hydroxylated aromatic compounds, such as resorcinol and catechol. Such reducing agents when used in the compositions are present in an amount of 0.01 to 10 g/L or such as from 0.1 to 5 g/L.

One or more other additives may be included in the electrolyte compositions. Such additives include, but are not limited to, surfactants and brightening agents.

For applications requiring good wetting capabilities, one or more surfactants may be included in the electrolyte compositions. Suitable surfactants are known to those skilled in the art, and include any which yield deposits having good solderability, good matte or lustrous finish where desired, satisfactory grain refinement, and are stable in the acidic electroplating compositions. Conventional amounts may be used.

Bright deposits may be obtained by adding brighteners to the electrolyte compositions of the present invention. Such brighteners are well known to those skilled in the art. Suitable brighteners include, but are not limited to aromatic aldehydes, such as chlorobenzaldehyde, or derivatives thereof, such as benzal acetone. Suitable amounts for the brighteners are known to those skilled in the art.

Other optional compounds may be added to the electrolyte compositions to provide further grain refinement. Such other compounds include, but are not limited to: alkoxylates, such as the polyethoxylated amines JEFFAMINE T-403 or TRITON RW, or sulfated alkyl ethoxylates, such as TRITON QS-15, and gelatin or gelatin derivatives. The amounts of such other compounds useful in the compositions are well known to those skilled in the art and when present are in a range of 0.1 to 20 mL/L or such as from 0.5 to 8 mL/L or such as from 1 to 5 mL/L.

Optionally, one or more grain refiner/stabilizer may be included in the compositions to further improve the electroplating operating window. Such grain refiners/stabilizers include, but are not limited to, hydroxylated gamma-pyrones, such as maltol, ethylmaltol, kojic acid, meconic acid; comenic acid, hydroxylated benzoquinones, such as chloranilic acid, dihydroxybenzoquinone, hydroxylated naphtoles, such as chromotropic acid, anthraquinone, hydroxylated pyridones, cyclopentandiones, hydroxy-furanones, hydroxy-pyrrolidones and cyclohexanediones. Such compounds may be included in the compositions in amounts of 2 to 10,000 mg/L or such as from 50 to 2000 mg/L.

The tin alloys electroplated from the electrolyte compositions may be used in the manufacture of electronic devices, such as in the formation of interconnect bumps on a semiconductor device in wafer-level-packaging. Electroplating baths containing the electrolyte compositions of the present invention are typically prepared by adding to a vessel one or more of the acids, followed by one or more of the solution soluble tin compounds, one or more of the flavone compounds, one or more of the solution soluble alloying metal compounds, one or more of the dihydroxy bis-sulfide compounds, one or more optional additives, and the balance water. Other orders of addition of the components of the compositions may be used. Once the aqueous composition is prepared, undesired material can be removed, such as by filtration, and then water is typically added to adjust the final volume of the composition. The composition may be agitated by any known means, such as stirring, pumping, or recirculating, for increased plating speed. The electrolyte compositions are acidic, i.e. having a pH of less than 7, typically less than 1.

The electrolyte compositions of the present invention are useful in many plating method where a tin alloy is desired and are low foaming in contrast to many conventional electrolyte compositions. Plating methods include, but are not limited to, horizontal or vertical wafer plating, barrel plating, rack plating and high speed plating such as reel-to-reel and jet plating. A tin alloy may be deposited on a substrate by the steps of contacting the substrate with the electrolyte composition and passing a current through the electrolyte to deposit the tin alloy on the substrate. Substrates which may be plated include, but are not limited to, copper, copper alloys, nickel, nickel alloys, nickel-iron containing materials, electronic components, plastics, and semiconductor wafers such as silicon wafers. Plastics which may be plated include, but are not limited to, plastic laminates, such as printing wiring boards, particularly copper clad printed wiring boards. The electrolyte compositions may be used for electroplating of electronic components, such as lead frames, semiconductor wafers, semiconductor packages, components, connectors, contacts, chip capacitors, chip resistors, printed wiring boards, and wafer interconnect bump plating applications. The substrate may be contacted with the electrolyte composition in any manner known in the art. Typically, the substrate is placed in a bath containing the electrolyte composition.

Current density used to plate the tin-alloy depends on the particular plating method. Generally, the current density is 1 or more A/dm$^2$ or such as from 1 to 200 A/dm$^2$ or such as from 2 to 30 A/dm$^2$ or such as from 2 to 20 A/dm$^2$ or such as from 2 to 10 A/dm$^2$ or such as from 2 to 8 A/dm$^2$.

The tin-alloys may be deposited at a temperature in a range of, but not limited to, 15° C. or higher, or such as from 15° to 66° C., or such as from 21° to 52° C., or such as from 23° to 49° C. In general, the longer the time the substrate is plated the thicker the deposit while the shorter the time the thinner the deposit for a given temperature and current density. Thus, the length of time a substrate remains in a plating composition may be used to control the thickness of the resulting tin alloy deposit. In general, metal deposition rates may be as high as 15 μm/min. Typically, deposition rates may range from 1 μm/min. to 10 μm/min., or such as from 3 μm/min. to 8 μm/min.

The electrolyte compositions may be used to deposit tin-alloys of various compositions. For example, alloys of tin and one or more of silver, copper, or bismuth may contain 0.01 to 25 wt % of the alloying metal(s) and 75 to 99.99 wt % tin or such as from 0.01 to 10 wt % of the alloying metal(s) and 90 to 99.99 wt % tin or such as from 0.1 to 5 wt % of the alloying metal(s) and 95 to 99.9 wt % tin, based on the weight of the alloy, as measured by either atomic adsorption spectroscopy ("AAS"), X-ray fluorescence ("XRF"), inductively coupled plasma ("ICP") or differential scanning calorimetry ("DSC"). For many applications, the eutectic composition of an alloy may be used. Such tin alloys are substantially free of lead and cyanides.

While the electrolyte compositions may be used for a variety of applications as described above, an exemplary application of the tin alloy compositions is for interconnect bump formation for wafer-level-packaging. This method involves providing a semiconductor die having a plurality of interconnect bump pads, forming a seed layer over the interconnect bump pads, depositing a tin-alloy interconnect bump layer over the interconnect bump pads by contacting the semiconductor die with the electrolyte composition and passing a current through the electrolyte composition to deposit the tin alloy interconnect bump layer on the substrate, and reflowing the interconnect bump layer.

In general, a device includes a semiconductor substrate on which is formed a plurality of conductive interconnect bump pads. The semiconductor substrate may be a single-crystal silicon wafer, a silicon-on-sapphire (SOS) substrate, or a silicon-on-insulator (SOI) substrate. The conductive interconnect bump pad may be one or more layers of a metal, composite metal or metal alloy typically formed by physical vapor deposition (PVD) such as sputtering. Typical conductive interconnect bump pad materials include, without limitation, aluminum, copper, titanium nitride, and alloys thereof.

A passivation layer is formed over the interconnect bump pads and openings extending to the interconnect bump pads are formed therein by an etching process, typically by dry etching. The passivation layer is typically an insulating material, for example, silicon nitride, silicon oxynitride, or a silicon oxide, such as phosphosilicate glass (PSG). Such materials may be deposited by chemical vapor deposition (CVD) processes, such as plasma enhanced CVD (PECVD).

An under bump metallization (UBM) structure formed typically of a plurality of metal or metal alloy layers, is deposited over the device. The UBM acts as an adhesive layer and electrical contact base (seed layer) for an interconnect bump to be formed. The layers forming the UBM structure may be deposited by PVD, such as sputtering or evaporation, or CVD processes. Without limitations, the UBM structure may be, for example, a composite structure including in order, a bottom chrome layer, a copper layer, and an upper tin layer.

A photoresist layer is applied to the device, followed by standard photolithographic exposure and development techniques to form a plating mask. The plating mask defines the size and location of a plating via over the I/O pad and UBM. Without limitation, the mushroom plating process generally employs a relatively thin photoresist layer, typically from 25 to 70 μm in thickness, while the in via plating process generally employs a relatively thick photoresist layer, typically from 70 to 120 μm in thickness. Photoresist materials are commercially available and well known in the art.

The interconnect bump material is deposited on the device by an electroplating process using the above-described electroplating compositions. Interconnect bump materials include, for example, tin-silver, tin-copper, tin-silver-copper, tin-bismuth, tin-silver-bismuth alloys and tin-silver-copper-bismuth alloys. Such alloys may have compositions such as described above. It may be desired to use such compositions at their eutectic concentrations. The bump material is electrodeposited in the areas defined by the plating via. For this purpose, a horizontal or vertical wafer plating system, for example, a fountain plating system, is typically used with a direct current (DC) or pulse-plating technique. In the mushroom plating process the interconnect bump material completely fills the via extending above and on a portion of the top surface of the plating mask. This ensures that a sufficient volume of interconnect bump material is deposited to achieve the desired ball size after reflow. In the in via plating process, the photoresist thickness is sufficiently thick such that the appropriate volume of interconnect bump material is contained within the plating mask via. A layer of copper or nickel may be electrodeposited in the plating via prior to plating the interconnect bump material. Such a layer may act as a wettable foundation to the interconnect bump upon reflow.

Following deposition of the interconnect bump material the plating mask is stripped using an appropriate solvent. Such solvents are well known in the art. The UBM structure is then selectively etched using known techniques, removing all metal from the field area around and between interconnect bumps.

The wafer is then optionally fluxed and is heated in a reflow oven to a temperature at which the interconnect bump material melts and flows into a truncated substantially spherical shape. Heating techniques are known in the art, and include, for example, infrared, conduction, and convection techniques, and combinations thereof. The reflowed interconnect bump is generally coextensive with the edges of the UBM structure. The heat treatment step may be conducted in an inert gas atmosphere or in air, with the particular process temperature and time being dependent upon the particular composition of the interconnect bump material.

The following examples are intended to further illustrate the invention, but are not intended to limit the scope of the invention.

EXAMPLE 1

An electrolyte composition was prepared by combining 50 g/L tin from tin methane sulfonate, 0.4 g/L silver from silver methane sulfonate, 70 g/L methane sulfonic acid, 8 g/L 3,6-dithia-1,8-octanediol, 1 g/L ethyl maltol, 4 g/L ethoxylated bisphenol A (13 ethylene oxide units), 30 mg/L pentahydroxy flavone, 1 g/L hydroquinone monosulfonic acid potassium salt, and deionized water (balance), at 30° C. Wafer segments of 4 cm×4 cm with photoresist patterned vias of 120 μm (diameter)×50 μm (depth) on copper seed were immersed in the composition in a glass container and plated with a layer of tin-silver at a current density of 6 A/dm$^2$.

Morphology of the resulting tin-silver layers was inspected with a Hitachi S2460™ scanning electron microscope. The deposits were uniform, smooth, compact, and free of nodules.

The silver concentrations of the resulting tin-silver layers for the samples were measured by an AAS method. The AAS apparatus used for measurements was manufactured by Varian, Inc. (Palo Alto, Calif.). The method included the following steps: 1) the photoresist was removed; 2) the seed layer was removed; 3) the weight of each tin-silver layer was measured, i.e. average of 10 mg; 4) each tin silver layer was then dissolved in a separate container having 10 to 20 mL of 30-40% nitric acid (more nitric acid was added if needed to dissolve the tin silver); 5) the dissolved tin silver from each beaker was then transferred to a separate 100 mL flask and brought to volume with deionized water and mixed; and 6) the amount of silver was measured in each solution and the concentrations of the silver were determined in the deposit using formulation: $\% \text{ Ag}=[10\times\text{AAS}_{Ag(ppm)}]/\text{Weight}_{(mg)}$. The tin-silver layers contained an average of 2.75% silver by weight.

EXAMPLE 2

An electrolyte composition was prepared by combining 50 g/L tin from tin methane sulfonate, 0.4 g/L silver from silver methane sulfonate, 70 g/L methane sulfonic acid, 1 g/L 3,6-dithia-1,8-octanediol, 1 g/L ethyl maltol, 4 g/L ethoxylated bisphenol A (13 ethylene oxide units), 10 mg/L pentahydroxy flavone, 1 g/L hydroquinone monosulfonic acid potassium salt, and deionized water (balance), at 30° C. Wafer segments of 4 cm×4 cm with photoresist patterned vias of 120 μm (diameter)×50 μm (depth), copper seed layer and 5 μm copper stud were immersed in the composition in a glass container and plated with a layer of tin-silver at a current density of 6 A/dm$^2$. After plaiting the photoresist and exposed copper seed layer were removed and tin-silver layers were inspected with a Hitachi S2460™ scanning electron microscope. The deposits were uniform, smooth, compact, and free of nodules.

The tin-silver layers were then reflowed to form bumps and the bumps were inspected using a WBI-Fox X-ray inspection system. The detection resolution was 0.3 μm. The inspection was done by Yxlon International. No voids were found in the bumps.

The silver concentration of the tin-silver layer bumps were measured by the AAS method described in Example 1 above. If some of the tin-silver bumps were removed with their copper studs attached, the composition of the bumps were adjusted for the copper studs by subtracting the copper content of the studs from the measured weight using formulation: $\% \text{ Ag}=[10\times\text{AAS}_{Ag(ppm)}]/\{\text{Weight}_{(mg)}-0.1\times[\text{AAS}_{Cu(ppm)}]\}$. The tin-silver bumps contained an average of 3% silver by weight.

EXAMPLE 3

An electrolyte composition was prepared by combining 50 g/L tin from tin methane sulfonate, 0.4 g/L silver from silver methane sulfonate, 70 g/L methane sulfonic acid, 8 g/L 3,6-dithia-1,8-octanediol, 1 g/L ethyl maltol, 4 g/L ethoxylated bisphenol A (13 ethylene oxide units), 50 mg/L pentahydroxy flavone, 1 g/L hydroquinone monosulfonic acid potassium salt, and deionized water (balance), at 30° C. Wafer segments of 4 cm×4 cm with photoresist patterned vias of 120 μm (diameter)×50 μm (depth), copper seed layer and 5 μm copper studs were immersed in the composition in a glass container and plated with a layer of tin-silver at a current density of 6 A/dm$^2$. After plating the photoresist and copper seed layer were removed and the morphology of the resulting tin-silver layer was inspected with the scanning electron microscope as described above. The deposit was uniform, smooth, compact, and free of nodules.

The tin-silver layers were then reflowed to form bumps and inspected using the WBI-Fox X-ray inspection system. No voids were found in the bumps.

The tin-silver bumps were then analyzed for silver content using the AAS method as described in Example 1 and 2 above. The bumps had an average silver concentration of 2.56% by weight.

EXAMPLE 4

An electrolyte composition was prepared by combining 50 g/L tin from tin methane sulfonate, 0.4 g/L silver from silver methane sulfonate, 70 g/L methane sulfonic acid, 5 g/L 3,6-dithia-1,8-octanediol, 1 g/L ethyl maltol, 7 g/L ethoxylated bisphenol A (13 ethylene oxide units), 30 mg/L pentahydroxy flavone, 1 g/L hydroquinone monosulfonic acid potassium salt, and deionized water (balance), at 30° C. Wafer segments of 4 cm×4 cm with photoresist patterned vias of 120 μm (diameter)×50 (depth), copper seed layer and 5 μm copper studs were immersed in the composition in a glass container and plated with a layer of tin-silver at a current density of 6 A/dm$^2$. After plating the photoresist and the copper seed layer were removed and the morphology of the tin-silver layer was inspected with the Hitachi scanning electron microscope. The deposit was uniform, smooth, compact, and free of nodules.

The tin-silver layers were then reflowed to form bumps and inspected using the WBI-Fox X-ray inspection system. No voids were found in the bumps.

The silver concentration of the tin-silver bumps was measured by the AAS method described above. The bumps contained an average of 2.74% silver by weight.

EXAMPLE 5

An electrolyte composition was prepared by combining 50 g/L tin from tin methane sulfonate, 0.4 g/L silver from silver methane sulfonate, 67.5 g/L 70% methanesulfonic acid, 2.7 g/L 3,6-dithia-1,8-octanediol, 1 g/L ethyl maltol, 4 g/L ethoxylated bisphenol A (13 ethylene oxide units), 50 mg/L pentahydroxy flavone, 1 g/L hydroquinone monosulfonic acid potassium salt, and deionized water (balance), at 30° C. 300 ml of electrolyte was placed in a 1000 mL graduated cylinder with air sparging conducted at 25° C. 20cm3 of foam was produced. A piece of steel Hull cell test panel was immersed in the composition in a Hull cell and plated with a layer of tin-silver at current of 3 A for 2 min. The highest deposition rate achieved was 5.3 μm/min.

EXAMPLE 6 (COMPARATIVE)

A conventional electrolyte composition was prepared by combining 20 g/L tin from tin methane sulfonate, 0.5 g/L silver from silver methane sulfonate, 150 g/L 70% methanesulfonic acid, 2 g/L 3,6-dithia-1,8-octanediol, 4 g/L ethoxylated nonylphenol (14 ethylene oxide units), and deionized water (balance), at 30° C. 300 ml of electrolyte was placed in a 1000 mL graduated cylinder with air sparging conducted at 25° C. A stable 600 cm$^3$ of foam was produced. A piece of steel Hull cell test panel was immersed in the composition in a Hull cell and plated with a layer of tin-silver at current of 3 A for 2 min. The highest deposition rate achieved was 2.4 μm/min. The conventional electrolyte composition had an undesirable level of foam formation in contrast to the electrolyte composition of Example 5. Also, the deposition rate of the electrolyte composition of Example 5 was greater than that of conventional composition.

EXAMPLE 7 (COMPARATIVE)

A conventional electrolyte composition was prepared by combining 50 g/L tin from tin methane sulfonate, 0.4 g/L silver from silver methane sulfonate, 70 g/L methane sulfonic acid, 8 g/L 3,6-dithia-1,8-octanediol, 1 g/L ethyl maltol, 4 g/L ethoxylated bisphenol A (13 ethylene oxide units), and deionized water (balance), at 30° C. Copper seeded wafer segments of 4 cm×4 cm with photoresist patterned vias of 120 μm (diameter)×50 μm (depth) were immersed in the composition in a glass container and plated with a layer of tin-silver at current density of 6 A/dm$^2$. Morphology of the resulting tin-silver layers was inspected with the Hitachi scanning electron microscope. The layers were smooth, compact, and free of nodules. However, the tin-silver layers were uneven under a Zeiss Axiovert 100A optical microscope. Accordingly, the tin-silver alloy layers produced by the tin alloy compositions of Examples 1-4 had improved tin-silver morphology in contrast to the tin-silver layers produced by the conventional alloy.

What is claimed is:

1. A method comprising:

a) contacting a substrate with a composition comprising one or more sources of tin ions, one or more sources of alloying metal ions, the metal ions are selected from the group consisting of silver ions, copper ions and bismuth ions, one or more flavone compounds, and one or more compounds having a formula:

HOR(R")SR'SR(R")OH wherein R, R' and R" are the same or different and are alkylene radicals having 1 to 20 carbon atoms; and b) passing a current through the composition to deposit the tin alloy on the substrate.

2. A method comprising:

a) providing a semiconductor die having a plurality of interconnect bump pads;

b) forming a seed layer over the interconnect bump pads;

c) depositing a tin-alloy interconnect bump layer over the interconnect bump pads by contacting the semiconductor die with a composition comprising one or more sources of tin ions, one or more sources of alloying metal ions, the metal ions are selected from the group consisting of silver ions, copper ions and bismuth ions, one or more flavone compounds, and one or more compounds having a formula:

HOR(R")SR'SR(R")OH wherein R, R' and R" are the same or different and are alkylene radicals having 1 to 20 carbon atoms; and passing a current through the composition to deposit the tin alloy interconnect bump layer on the substrate; and d) reflowing the interconnect bump layer.

3. A composition comprising one or more sources of tin ions, one or more sources of alloying metal ions, the metal ions are selected from the group consisting of silver ions, copper ions and bismuth ions, one or more flavone compounds, and one or more compounds having a formula:

HOR(R")SR'SR(R")OH wherein R, R' and R" are the same or different and are alkylene radicals having 1 to 20 carbon atoms.

4. The composition of claim 3, further comprising one or more grain refiner/stabilizer compounds.

5. The composition of claim 3, wherein the ions of the alloying metal is silver.

6. The composition of claim 3, wherein the one or more flavone compounds are chosen from pentahydroxy flavone, chrysin, fisetin, rutin, quercetin, myricetin and quercitrin.

7. The composition of claim 3, further comprising one or more suppressor.

8. The composition of claim 3, wherein the one or more flavone compounds are in amounts of 10 mg/L to 50 mg/L.

* * * * *